United States Patent [19]

English et al.

[11] 4,017,286

[45] Apr. 12, 1977

[54] HEAT PUMP SUCTION LINE VENT

[75] Inventors: William A. English, Franklin, Pa.; Charles J. Robinson, Norman, Okla.

[73] Assignee: Westinghouse Electric Corporation, Pittsburgh, Pa.

[22] Filed: Dec. 22, 1975

[21] Appl. No.: 642,808

[52] U.S. Cl. ..... 62/160; 62/196 C; 62/324

[51] Int. Cl.[2] ..... F25B 13/00; F25B 41/00

[58] Field of Search ..... 62/160, 324, 151, 196 C, 62/196 R

[56] References Cited

UNITED STATES PATENTS

| | | | |
|---|---|---|---|
| 1,870,458 | 8/1932 | Kenney | 62/196 C |
| 2,363,273 | 11/1944 | Waterfill | 62/196 C |
| 2,938,361 | 5/1960 | McNatt | 62/160 |
| 3,068,661 | 12/1962 | McGrath | 62/160 |
| 3,280,582 | 10/1966 | Knaebel | 62/324 |
| 3,768,274 | 10/1973 | Fink | 62/324 |

*Primary Examiner*—Lloyd L. King
*Attorney, Agent, or Firm*—E. C. Arenz

[57] ABSTRACT

A one way check valve is connected between the suction line and discharge line so that immediately after operation of the reversing valve of the system the momentary high pressure derived from the coil which has been operated at the higher pressure is vented to the discharge line then connected to the coil which had been operating at the lower pressure.

3 Claims, 2 Drawing Figures

HEAT PUMP SUCTION LINE VENT

BACKGROUND OF THE INVENTION

1. Field of the Invention

The invention pertains to the art of heat pumps (i.e., reversible refrigeration systems) and in particular to an arrangement for venting a higher pressure to a lower pressure following a reversal of the system.

2. Description of the Prior Art

One known problem experienced when heat pump systems are reversed, and in particular when the heat pump system has been operating in the heating mode and defrosting the outdoor coil is required, is that upon the shift to the defrosting cycle the suction line to the compressor is then connected to the high pressure interior of the indoor coil which had been functioning as a condenser, and the discharge line of the compressor is then connected to the low pressure interior of the outdoor coil which had been functioning as an evaporator. This momentary reversed pressure condition of a higher pressure at the suction side than at the discharge side of the compressor tends to result in expansion through it rather than compression. Since the compressor crankcase is open to the compressor suction line, the higher pressure tends to force crankcase oil up into the cylinders where it is pumped out into the system. To the degree that this oil pumping condition repeatedly occurs, the oil level may be reduced to a point causing a bearing failure in the compressor.

One known way to avoid this problem is to provide an arrangement in which the system is unloaded before the reversing valve changes to its final position. Such an arrangement also has as an object the reduction of the forces required to operate the reversing valve. Examples of arrangements of this general type are found in U.S. Pat. Nos. 2,597,729; 2,713,250; and 2,768,506. The first two noted patents have arrangements in which the reversing valve means operates only after the pressure differential within the system has completely or nearly disappeared, and use solenoid actuated unloader valves which may be tied into a time control circuit. The last noted patent provides an arrangement which includes a combination unloading and reversing valve and which is controlled in part at least by a common port on the valve connected to both the suction and discharge lines from the compressor through separate solenoid valve controlled lines. The combination valve includes a sequence, when a reversal is to take place, which includes leaking from the high pressure coil to the suction line to take away the valve shifting responsibility from one part of the device, and also includes substantially closing the suction line connection to, and opening the discharge line to, the low pressure coil. This results in drawing down the discharge line pressure. Subsequently, a valve element which has substantially isolated the high pressure coil from the discharge line is opened so that both the discharge line and the high pressure coil can feed high pressure refrigerant to both the low pressure coil and the suction line, this continuing until the coil pressures are equalized. Thereafter, through movement of several valve elements in response to changing pressure conditions, the system is set for the reversed operation. Thus the basic operation is that of unloading before the ultimate reversal is made, and in that sense the system is essentially the same as that of the other two patents and requires a delay as well as an unloading operation with refrigerant flow in both directions.

The aim of the present invention is to provide a substantially simpler arrangement and in which a simple, one direction check valve functions automatically after the reversing valve has operated to a reversed operation. The arrangement of the invention is considered preferable in that it is inexpensive, does not require complicated valve parts, and is not subject to the delay encountered when pressures are to be bled to equalize the system before the reversing valve changes position.

SUMMARY OF THE INVENTION

In accordance with the invention a reversible heat pump system which includes indoor and outdoor coils, a compressor, a reversing valve for controlling which coil functions as a condenser and which as an evaporator, and a suction line and a discharge line connecting the compressor to the reversing valve, has an arrangement including a one way check valve connected between the suction line and the discharge line to vent the suction line to the discharge line while the compressor continues operation and after the reversing valve operates from one to an opposite position to reverse the functions of the coils.

DRAWING DESCRIPTION

FIG. 1 is a diagrammatic view of a heat pump arrangement according to the invention set to operate in a heating mode; and FIG. 2 is a view as in FIG. 1 with the heat pump switched to operate in a cooling or defrost mode.

DESCRIPTION OF THE PREFERRED EMBODIMENT

Figure 1:
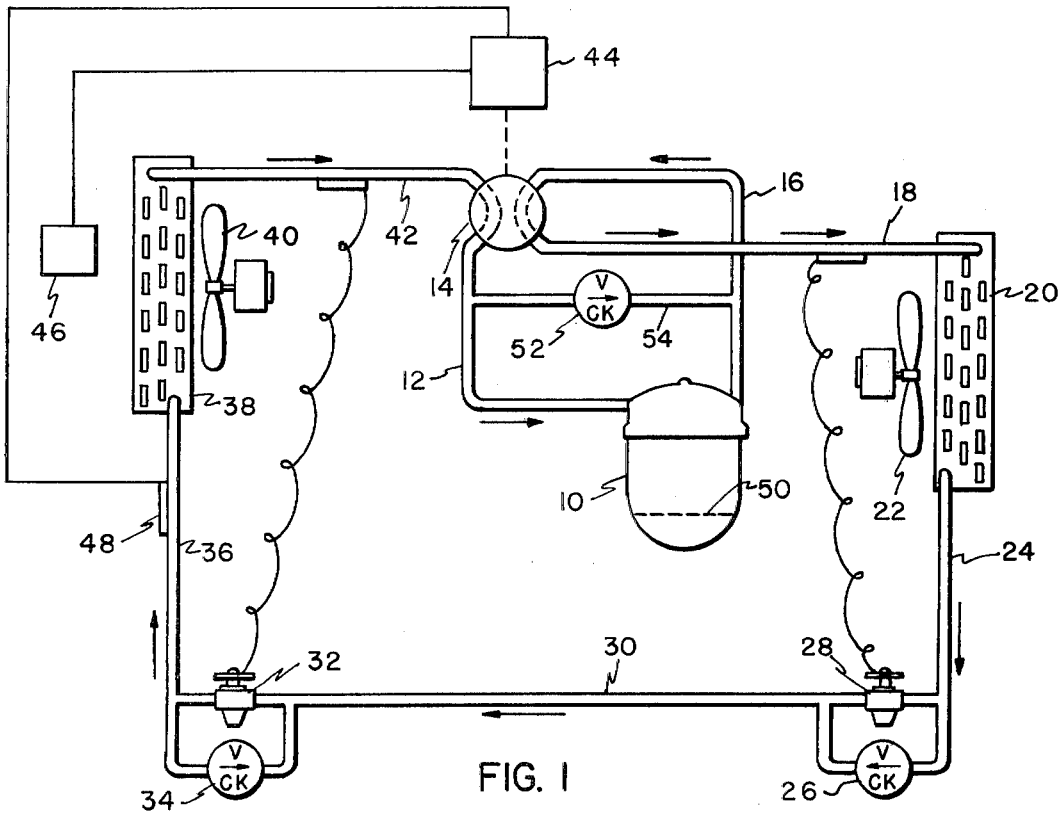

Referring to FIG. 1, the basic heat pump arrangement is conventional and includes a refrigerant compressor 10 which draws vaporous refrigerant through suction line 12 connected to reversing valve 14, compresses the refrigerant admitted to the compressor shell, and forces the hot high pressure gaseous refrigerant through discharge line 16 to the reversing valve 14.

With the reversing valve 14 set as shown in FIG. 1, the hot, high pressure gas is passed through line 18 to an indoor heat exchange coil 20 which, in the heating mode operation of FIG. 1, functions as a condenser in which heat is extracted from the refrigerant and is liquefied by virtue of air driven across the coil by the fan 22. The heat extracted is of course used to condition the structure served by the heat pump.

The hot liquid refrigerant then passes through line 24, check valve 26 (bypassing cooling cycle expansion device 28), and into line 30 connected to the heating cycle expansion device 32. The expansion device is in parallel with a check valve 34 which permits the flow of refrigerant therethrough only during a cooling cycle or defrost cycle operation. The expanded refrigerant flows through line 36 into the outdoor coil 38 which, in the heating mode of operation, functions as an evaporator in which the refrigerant is vaporized by the absorption of heat from the outside air blown across it by the fan 40. The low pressure vaporized refrigerant is then returned to the suction line 12 through line 42 and reversing valve 14.

The operation of the reversing valve for purposes of carrying out a defrost cycle may be controlled in various ways. In the illustrated arrangement a controller 44 is responsive to a predetermined air pressure drop across the outdoor coil 38 by means of a pressure sensitive device 46 for initiating a defrost cycle, and is also responsive to a refrigerant temperature sensor 48 which measures the temperature of a refrigerant leaving the coil to terminate the defrosting operation. The remainder of the controls, such as a room air thermostat for controlling operation of the compressor in accordance with temperature demand, and controlling supplemental heaters if used, may be conventional and are not shown.

When the heat pump system is operated in a heating mode with the reversing valve 14 positioned as shown in FIG. 1, the indoor coil 20 functions as a condenser and the outdoor coil 38 functions as an evaporator. When the heating operation occurs with the outdoor temperatures below about 40° there will tend to be a frost buildup on the outdoor coil 38 which must be periodically removed so that the heat transfer between the outdoor air and the outdoor coil remains effective.

Figure 2:
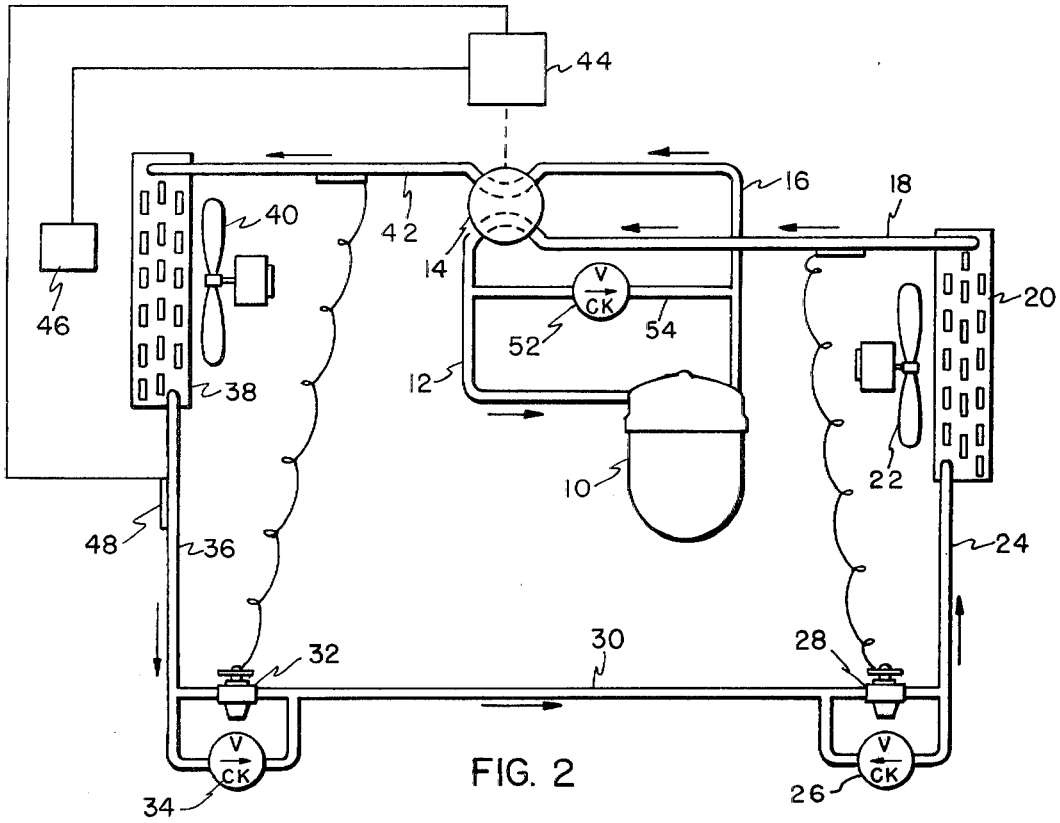

When the frost buildup reaches the point that the air pressure drop across the outdoor coil exceeds that to which the pressure drop sensor 46 is set, the controller 44 will operate the reversing valve 14 to the position shown in FIG. 2. Before this reversal occurs, the system condition is such that the outdoor coil is relatively cold, such as 0° to 10° F., (−18° to −12° C) and the indoor coil will be at a temperature of say 100° to 110° F. (38° to 43° C.). For each such temperature there is of course a corresponding pressure for any given refrigerant in the system. Assuming that the system uses R-22 refrigerant, then the pressures in the outdoor coil and in the indoor coil will be about 40 to 47 psia (0.28 to 0.3 Pa.) and about 210 to 240 psia (1.45 to 1.65 Pa.). Substantially the same differential in pressures exists of course between the suction line 12 and discharge line 16 connected to the compressor.

For present purposes the compressor 10 may be considered to be of the low side type in which the suction line passes refrigerant gas to the interior of the hermetically sealed shell and in which the discharge line 16 is directly connected to the cylinder heads. Such compressors have a pool of lubricating oil as indicated at 50 in the drawing. With the sudden reversal of pressures in the indoor coil there is a tendency for the high temperature refrigerant from the indoor coil to flood back to the suction line 12 carrying some liquid refrigerant back to the compressor suction. Also, with the outdoor coil being cold from its former operation as evaporator, there is a rapid collapse of the refrigerant gas flowing to it when the defrost cycle is initiated. In the ordinary heat pump without the arrangement of this invention or provision for shutdown and/or equalization before reversal, there results a higher suction than discharge pressure at the compressor, with the reversed pressure across the pistons and cylinders tending to force crankcase oil up into the cylinders from where it is pumped out into the system. To the extent that pumping of oil into the system occurs repeatedly, there is the possibility of the compressor running at times without adequate lubrication before the oil returns to the compressor. Conventional suction line accumulators (not shown although they may be used in a heat pump to which the invention is applicable) provides some protection against liquid slugging to the compressor but also introduces the problem of delay in return of refrigerant to the compressor.

In accordance with the invention a one way check valve 52 is installed in the line 54 connecting the suction line to the discharge line to vent the suction line to the discharge line at any time when the reversing valve is operated to a reversed position in which the suction line is then connected to a higher pressure coil than the coil to which the discharge line is then connected. Thus, when the system is switched from the FIG. 1 to the FIG. 2 mode of operation the high pressure refrigerant from the indoor coil 20 is vented through line 18, the reversing valve 14, into suction line 12 and then directly through the one way check valve 52 to the discharge line 16. This avoids the oil pumping problem which would result with the compressor operating with the reverse pressures across the cylinders.

The mode of operation during a defrost cycle is of course the same mode of operation as when the heat pump is in a cooling cycle. That is, the indoor coil 20 is functioning as an evaporator while the outdoor coil 38 is functioning as a condensor. While this is occurring the higher pressure coil will be the outdoor coil 38 and the lower pressure coil will be the indoor coil 20. Then after the outdoor coil has been sufficiently defrosted, the elevated refrigerant temperature sensed by the element 48 will result in the controller 44 switching the reversing valve 14 back to the heating mode of operation so that the system will have the interconnections as shown in FIG. 1 again. When this occurs, the check valve 52 again functions to vent from the suction line 12 back to the discharge line 16 as explained before, and again the problem of pushing oil out into the system is avoided.

The arrangement operates to attain its intended purpose whenever any changeover from heating to cooling or vice versa occurs. However, since the frequency of such changeovers in accordance with changes of outdoor temperature is small compared to the number of reversals during defrosting cycles in a heating season, the major benefit of the invention is obtained in connection with defrost cycles. Among the benefits is that it allows the passage of any liquid refrigerant through the check valve upon reversal to avoid passing such liquid into the crankcase and also reducing disturbance of the oil in the crankcase.

What we claim is:

1. A heat pump system including:

refrigerant compressor means;

a first refrigerant coil selectively operable as a condenser and as an evaporator;

a second refrigerant coil selectively operable as an evaporator and as a condenser in reverse relation to said first coil;

a reversing valve;

a refrigerant discharge line, and a refrigerant suction line, connecting said compressor means to said reversing valve;

refrigerant lines connecting each of said coils to said reversing valve, and a refrigerant line connecting said coils;

control means to effect a rapid reversal of said reversing valve while said compressor is running to initiate a defrost cycle and subsequently to effect another reversal of said reversing value to its original position to terminate the defrost cycle; and line means including a one way check valve connecting said suction line to said discharge line to vent said suction line to said discharge line upon said reversal of said reversing valve.

2. A heat pump system including:

refrigerant compressor means;

a first refrigerant coil selectively operable as a condenser and as an evaporator;

a second refrigerant coil selectively operable as an evaporator and as a condenser in reverse relation to said first coil;

a reversing valve;

a refrigerant discharge line, and a refrigerant suction line, connecting said compressor means to said reversing valve;

refrigerant lines connecting each of said coils to said reversing valve, and a refrigerant line connecting said coils; and line means including a one way check valve connecting said suction line to said discharge line to vent said suction line to said discharge line, while said compressor means is running, after operation of said reversing valve to a position connecting said suction line to a coil having a higher pressure than the coil to which the discharge line is then connected.

3. In a reversible heat pump system including indoor and outdoor coils, a compressor, a reversing valve for controlling which coil functions as a condenser and which as an evaporator, and a suction line and a discharge line connecting the compressor to the reversing valve, the improvement comprising: line means including a one way check valve connected between said suction line and said discharge line to vent the suction line to the discharge line while the compressor is running after said operation of said reversing valve first to a defrost position and then to a defrost terminating position.

* * * * *